US010773524B2

(12) United States Patent
Mizuno

(10) Patent No.: US 10,773,524 B2
(45) Date of Patent: Sep. 15, 2020

(54) LIQUID DISCHARGE APPARATUS

(71) Applicant: BROTHER KOGYO KABUSHIKI KAISHA, Nagoya-shi, Aichi-ken (JP)

(72) Inventor: Taisuke Mizuno, Yokkaichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/533,289

(22) Filed: Aug. 6, 2019

(65) Prior Publication Data

US 2020/0101743 A1 Apr. 2, 2020

(30) Foreign Application Priority Data

Sep. 27, 2018 (JP) ..... 2018-182380

(51) Int. Cl.
*B41J 2/175* (2006.01)
*B41J 2/14* (2006.01)

(52) U.S. Cl.
CPC ..... *B41J 2/175* (2013.01); *B41J 2/14* (2013.01); *B41J 2/14233* (2013.01); *B41J 2002/14241* (2013.01); *B41J 2202/05* (2013.01); *B41J 2202/07* (2013.01); *B41J 2202/12* (2013.01)

(58) Field of Classification Search
CPC . B41J 2/175; B41J 2/14; B41J 2202/07; B41J 2202/05; B41J 2002/14241; B41J 2202/12; B41J 2/14233
See application file for complete search history.

(56) References Cited

U.S. PATENT DOCUMENTS

2011/0193920 A1* 8/2011 Aruga ..... B41J 2/175 347/93
2014/0063088 A1* 3/2014 Shibata ..... B41J 2/175 347/6
2020/0047501 A1* 2/2020 Kameshima ..... B41J 2/14016
2020/0108629 A1* 4/2020 Nakano ..... B41J 2/14

FOREIGN PATENT DOCUMENTS

JP 2006-88492 A 4/2006

* cited by examiner

*Primary Examiner* — Henok D Legesse
(74) *Attorney, Agent, or Firm* — Merchant & Gould P.C.

(57) ABSTRACT

There is provided a liquid discharge apparatus including: a plurality of individual channels; a supply channel; a return channel; an open/close valve; a pump provided on the return channel; and a controller. In a case that the controller removes an air bubble, the controller is configured to execute: circulation of the liquid along a circulation route by maintaining the open/close valve at an open position and driving the pump; and then moving of the liquid from the storing chamber to the plurality of individual channels via the return channel so as to exhaust the liquid from the plurality of nozzles of the plurality of individual channels, respectively, by maintaining the open/close valve at a close position and driving the pump.

28 Claims, 9 Drawing Sheets

LIQUID DISCHARGE APPARATUS

CROSS REFERENCE TO RELATED APPLICATION

The present application claims priority from Japanese Patent Application No. 2018-182380, filed on Sep. 27, 2018, the disclosure of which is incorporated herein by reference in its entirety.

BACKGROUND

Field of the Invention

The present disclosure relates to a liquid discharge apparatus having a supply channel and a return channel.

Description of the Related Art

Conventionally, there is a publicly known technique for circulating an ink in a direction which is reverse to a direction adopted during printing, in an ink-jet recording head of a circulation type during maintenance performed therefor.

However, only by circulating the ink in the reverse direction, it is not possible to remove any air bubble inside the channel (in particular, an air bubble in the vicinity of a nozzle in an individual channel), in some cases.

An object of the present disclosure is to provide a liquid discharge apparatus capable of removing the air bubble more assuredly.

According to an aspect of the present disclosure, there is provided a liquid discharge apparatus including: a plurality of individual channels in which a plurality of nozzles are opened, respectively; a supply channel communicating with an outlet port of a storage chamber storing a liquid and with an inlet port of each of the plurality of individual channels; a return channel communicating with an outlet port of each of the plurality of individual channels and with an inlet port of the storage chamber; an open/close valve which is provided on the supply channel and which is switchable between an open position allowing communication between the storing chamber and the plurality of individual channels via the supply channel and a close position suppressing the communication; a pump provided on the return channel; and a controller. In a case that an air bubble is removed, the controller is configured to control the open/close valve and the pump so as to execute: circulation of the liquid along a circulation route starting from, and returning to, the storing chamber via the supply channel, the plurality of individual channels and the return channel by maintaining the open/close valve at the open position and driving the pump; and then moving of the liquid from the storing chamber to the plurality of individual channels via the return channel and exhausting of the liquid from the plurality of nozzles of the plurality of individual channels, respectively, by maintaining the open/close valve at the close position and driving the pump.

According to another aspect of the present disclosure, there is provided a liquid discharge apparatus including: a plurality of individual channels which include a plurality of nozzles, respectively; a supply channel communicating with an outlet port of a storage chamber storing a liquid and with an inlet port of each of the plurality of individual channels; a return channel communicating with an outlet port of each of the plurality of individual channels and an inlet port of the storage chamber; a check valve which is provided on the supply channel and which is configured to allow a flow of the liquid from the storing chamber to the plurality of individual channels via the supply channel and to suppress a flow of the liquid from the plurality of individual channels to the storing chamber via the supply channel; a pump provided on the return channel; and a controller. In a case that the controller removes an air bubble, the controller is configured to control the pump so as to execute: circulation of the liquid along a circulation route starting from, and returning to, the storing chamber via the supply channel, the plurality of individual channels and the return channel, by driving the pump; and then moving of the liquid from the storing chamber to the plurality of individual channels via the return channel and exhausting of the liquid from the plurality of nozzles of the plurality of individual channels, respectively, by driving the pump.

DESCRIPTION OF THE EMBODIMENT

First Embodiment

Figure 1:
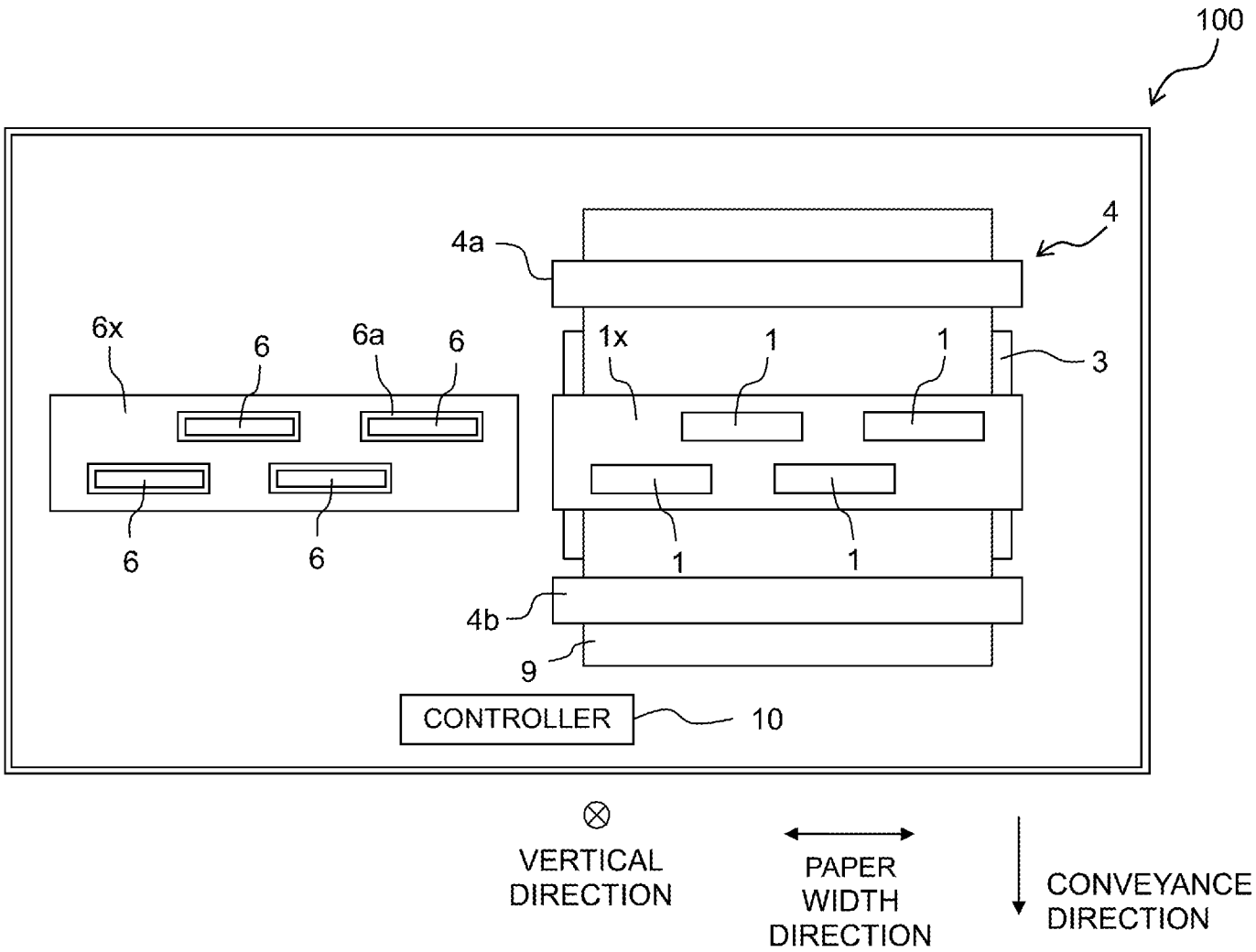
FIG. 1 is a plan view of a printer 100.

Firstly, the configuration of a printer 100 according to a first embodiment will be explained, with reference to FIG. 1.

The printer 100 has a head unit 1*x* which includes four heads 1; a platen 3; a conveying mechanism 4; a cap unit 6*x*; and a controller 10.

The conveying mechanism 4 has two pairs of rollers 4*a* and 4*b* which are arranged in a conveyance direction (direction orthogonal to the vertical direction) with the platen 3 intervened therebetween. In a case that a conveyance motor 4*m* (see FIG. 4) is driven, the pairs of rollers 4*a* and 4*b* are thereby rotated in a state that each of the pairs of rollers 4*a* and 4*b* hold a paper sheet 9 (paper 9) therebetween so as to convey the paper sheet 9 in the conveyance direction.

The head unit 1*x* is an ink-jet head of a line system, and is elongated in a paper width direction which is a direction orthogonal to the vertical direction and the conveyance direction. Note that the term "ink-jet head of the line system" means an ink-jet head of such a system wherein an ink is discharged or jetted toward the paper sheet 9 from a plurality of nozzles 33*d* (see FIGS. 2 and 3) in a state that the position of the ink-jet head is fixed. The four heads 1 are arranged in a staggered manner in the paper width direction. The lower surface of each of the heads 1 is a nozzle surface 25*a* formed with the plurality of nozzles 33*d* (see FIG. 3).

Further, the head unit 1x is driven by a head moving motor 1m (see FIG. 4) to be movable in the paper width direction between a position at which the four heads 1 overlap, in the vertical direction, with the platen 3 (recording position: see FIG. 1) and a position at which the four heads 1 overlap, in the vertical direction, with the four caps 6, respectively (stand-by position).

The platen 3 is a member having a shape of a flat plate, and is arranged at a position below the head unit 1x which is at the recording position, and between the two pairs of rollers 4a and 4b in the conveyance direction. The paper sheet 9 is placed on the upper surface of the platen 3.

The cap unit 6x is located on a side opposite to the head unit 1x, with respect to the platen 3, in the paper width direction; the cap unit 6x includes the four caps 6 corresponding to the four heads 1, respectively, of the head unit 1x. Each of the caps 6 has an annular-shaped lip part 6a which is formed of an elastic body. Further, a suction pump P3 (see FIG. 4) is connected to the four caps 6. The four caps 6 are communicated with a waste ink tank (not depicted in the drawings) via the suction pump P3.

Figure 4:
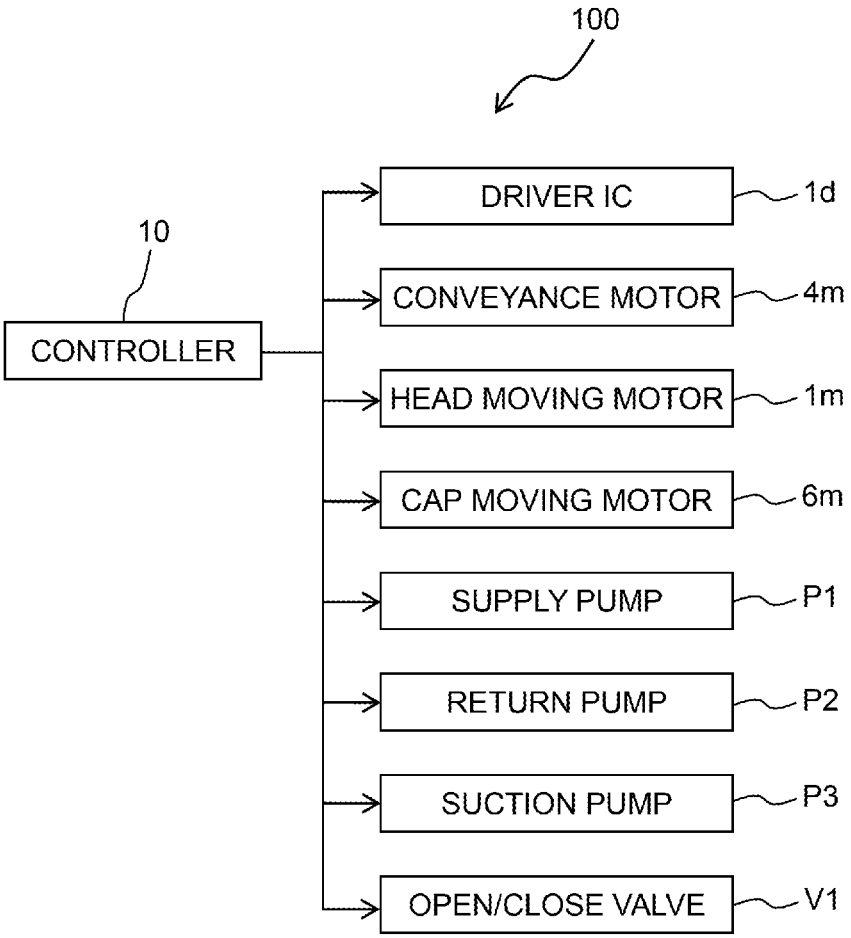
FIG. 4 is a block diagram depicting the electrical configuration of the printer 100.

Further, the cap unit 6x is movable in the vertical direction by being driven by a cap moving motor 6m (see FIG. 4). In a case that the head unit 1x is at the stand-by position, the cap unit 6x is moved in the vertical direction to thereby allow each of the caps 6 to assume (to be arranged at) a position at which the lip part 6a is located at a position below the nozzle surface 25a and does not cover the nozzle surface 25a (uncapping position), and a position at which the lip part 6a makes contact with the nozzle surface 25a and covers the nozzle surface 25a (capping position). In a case that the each of the caps 6 is at the capping position, each of the caps 6 covers all the plurality of nozzles 33d of one of the heads 1. In a case that the suction pump P3 (see FIG. 4) is driven in this situation, suction force is generated in the inside of each of the caps 6, which in turn causes the ink inside all the plurality of nozzles 33d in the inside of one of the heads 1 to be exhausted (discharged) to the waste ink tank (not depicted in the drawings).

The controller 10 has a ROM (Read Only Memory), a RAM (Random Access Memory), and an ASIC (Application Specific Integrated Circuit). The ASIC performs a recording processing, an air-bubble removing processing, etc., in accordance with programs stored in the ROM. In the recording processing, the controller 10 controls a driver IC 1d of each of the heads 1 and the conveyance motor 4m (for both of which, see FIG. 4) based on a recording instruction, image data, etc., inputted to the controller 10 from an external apparatus or device such as a PC (Personal Computer) to thereby record an image, etc., on the paper sheet 9. Note that there is such a case that the recording instruction and the image data are inputted separately from each other, and there is also such a case that the image data is included in the recording instruction.

Next, the configuration of each of the heads 1 will be explained.

Figure 3:
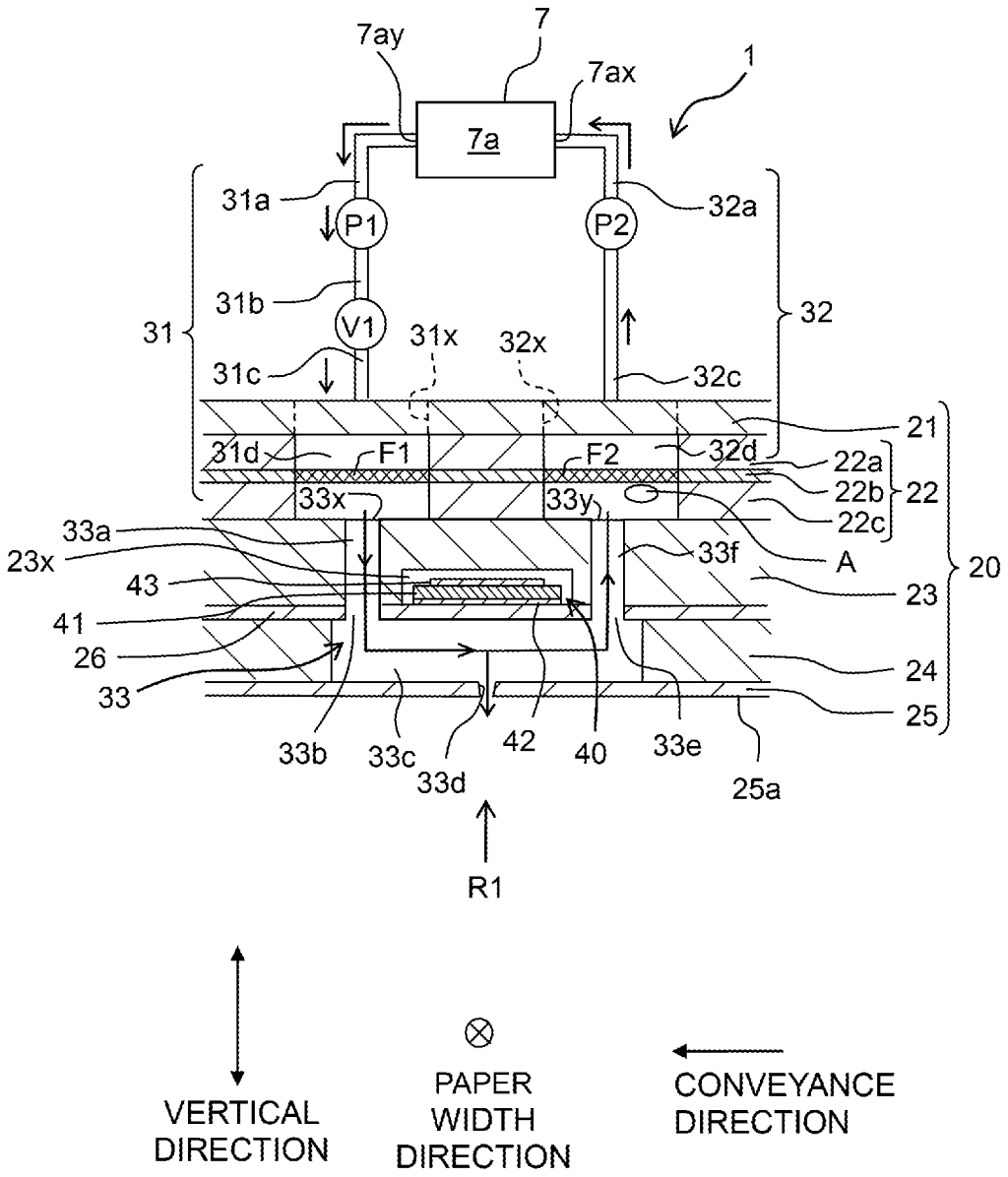
FIG. 3 is a cross-sectional view of the head 1 along a line in FIG. 2.

As depicted in FIG. 3, each of the heads 1 has a channel unit 20 including four plates 21, 23, 24 and 25 and a plate unit 22, and four actuators 40. The four plates 21 and 23 to 25 and the plate unit 22 are adhered to one another in a state that the four plates 21 and 23 to 25 and the plate unit 22 are stacked on one another in the vertical direction.

The plate 25 is located on the lowermost side among the four plates 21 and 23 to 25 and the plate unit 22. The plate 25 has a plurality of through holes constructing the plurality of nozzles 33d, respectively. The lower surface of the plate 25 corresponds to the nozzle surface 25a.

The plate 24 is arranged on the upper surface of the plate 25. The plate 24 has a plurality of through holes constructing a plurality of pressure chambers 33c, respectively. Each of the pressure chambers 33c are formed for one of the nozzles 33d. Each of the nozzles 33d is overlapped, in the vertical direction, with a central part or portion in the paper width direction and of the conveyance direction of one of the pressure chambers 33c.

Figure 2:
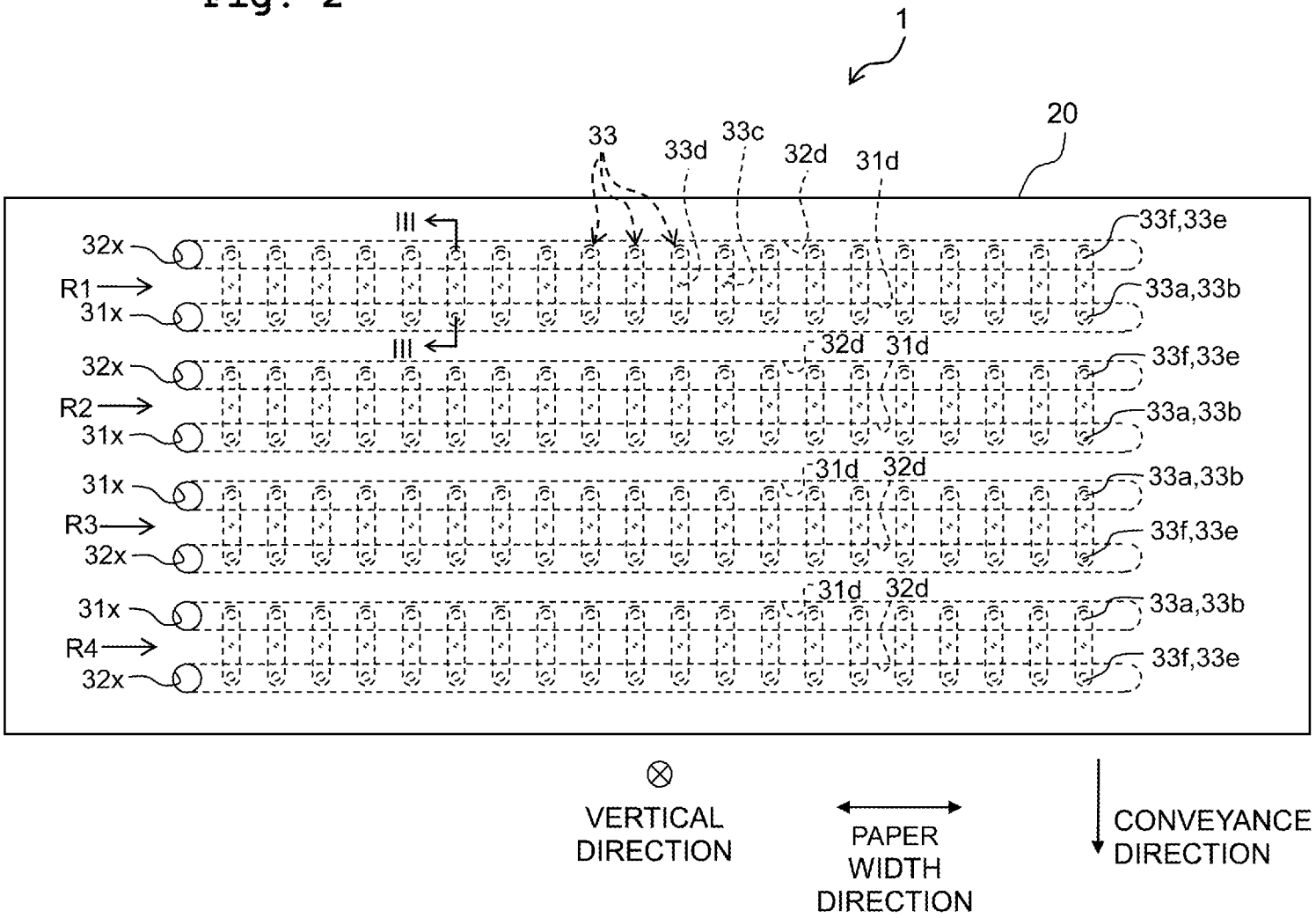
FIG. 2 is a plan view of a head 1 included in the printer 100.

Sets or pairs each of which constructed of one piece of the nozzles 33d and one piece of the pressure chambers 33c are aligned in the paper width direction, as depicted in FIG. 2, so as to form four rows R1 to R4. The four rows R1 to R4 are arranged side by side to one another in the conveyance direction. The four actuators 40 are provided to correspond to these four rows R1 to R4, respectively. A black ink is discharged from nozzles 33d included in the plurality of nozzles 33d and belonging to the row R1 which is the first row, among the four rows R1 to R4, from the upstream side in the conveyance direction. A yellow ink is discharged from nozzles 33d included in the plurality of nozzles 33d and belonging to the row R2 which is the second row, among the four rows R1 to R4, from the upstream side in the conveyance direction. A cyan ink is discharged from nozzles 33d included in the plurality of nozzles 33d and belonging to the row R3 which is the third row, among the four rows R1 to R4, from the upstream side in the conveyance direction. A magenta ink is discharged from nozzles 33d included in the plurality of nozzles 33d and belonging to the row R4 which is the fourth row, among the four rows R1 to R4, from the upstream side in the conveyance direction.

A vibration film 26 is arranged on the upper surface of the plate 24, as depicted in FIG. 3. The vibration film 26 covers the plurality of pressure chambers 33c. Through holes constructing inflow paths 33b, respectively, are formed in the vibration film 26 at parts thereof which overlap, in the vertical direction, with downstream-side end parts in the conveyance direction of the pressure chambers 33c belonging to the rows R1 and R2, respectively (see FIG. 2); further, through holes constructing the inflow paths 33b, respectively, are formed in the vibration film 26 at parts thereof which overlap, in the vertical direction, with upstream-side end parts in the conveyance direction of the pressure chambers 33c belonging to the rows R3 and R4, respectively (see FIG. 2). Furthermore, through holes constructing outflow paths 33e, respectively, are formed in the vibration film 26 at parts thereof which overlap, in the vertical direction, with upstream-side end parts in the conveyance direction of the pressure chambers 33c belonging to the rows R1 and R2, respectively (see FIG. 2); further, through holes constructing the outflow paths 33e, respectively are formed in the vibration film 26 at parts thereof which overlap, in the vertical direction, with downstream-side end parts in the conveyance direction of the pressure chambers 33c belonging to the rows R3 and R4, respectively (see FIG. 2). The vibration film 26 is formed, for example, by oxidizing the upper surface of the plate 24. For example, the vibration film 26 can be composed of silicon dioxide ($SiO_2$).

The plate 23 is arranged on the upper surface of the vibration film 26. As depicted in FIGS. 2 and 3, through holes constructing inflow paths 33a, respectively, are formed in the plate 23 at parts thereof which overlap, in the vertical direction, with the inflow paths 33b, respectively; and through holes constructing outflow paths 33f, respectively, are formed in the plate 23 at parts thereof which overlap, in the vertical direction, with the outflow paths 33e, respectively. As depicted in FIG. 3, the lower surface of the plate 23 is formed with four recessed parts 23x accommodating the four actuators 40, respectively. Each of the actuators 40 is arranged in a space defined by the vibration film 26 and one of the recessed parts 23*x*.

Each of the actuators 40 has a common electrode 42 arranged on the upper surface of the vibration film 26, a piezoelectric body 41 arranged on the upper surface of the common electrode 42, and a plurality of individual electrodes 43 arranged on the upper surface of the piezoelectric body 41. The piezoelectric body 41 and the common electrode 42 extend in the paper width direction so as to straddle over (cover) the pressure chambers 33*c* belonging to each of the rows R1 to R4. Each of the individual electrodes 43 is provided with respect to one of the pressure chambers 33*c*, and overlaps with one of the pressure chambers 33*c* in the vertical direction.

The common electrode 42 and the plurality of individual electrodes 43 are electrically connected to the driver IC 1*d* (see FIG. 4). The driver IC 1*d* is controlled by the controller 10 such that the driver IC 1*d* maintains the potential of the common electrode 42 to the ground potential while changing the potential of the individual electrodes 43. Specifically, the driver IC 1*d* generates a driving signal based on a control signal from the controller 10, and applies the driving signal to a certain individual electrode 43 included in the plurality of individual electrodes 43. With this, the potential of the certain individual electrode 43 is changed between a predetermined driving potential and the ground potential. In this situation, parts or portions of the vibration plate and the piezoelectric body 41, respectively, which are sandwiched between the certain individual electrode 43 and a certain pressure chamber 33*c* included in the plurality of pressure chambers 33*c* and corresponding to the certain individual electrode 43 are deformed to project toward the certain pressure chamber 33*c*, thereby changing the volume of the certain pressure chamber 33*c* and imparting the pressure to the ink inside the certain pressure chamber 33*c*, which in turn cause the ink to be discharged from a nozzle 33*d* included in the plurality of nozzles 33*d* and corresponding to the certain pressure chamber 33*c*.

The plates 23 to 25 and the vibration film 26 are formed with a plurality of individual channels 33 each of which is constructed of the inflow paths 33*a*, 33*b*, the pressure chamber 33*c*, the nozzle 33*d* and the outflow paths 33*e* and 33*g*. Each of the individual channels 33 has a shape which is symmetric in the conveyance direction with respect to a straight line along the vertical direction and passing through the nozzle 33*d*.

The plate unit 22 is arranged on the upper surface of the plate 23. The plate unit 22 is formed with four supply common channels 31*d* and four return common channels 32*d*. As depicted in FIG. 2, a pair or set constructed of one supply common channel 31*d* and one return common channel 32*d* is provided on each of the four rows R1 to R4. The supply common channel 31*d* and the return common channel 32*d* belonging to one set are arranged side by side to each other in the conveyance direction. Between the rows R1 and R2 and the rows R3 and R4, the arrangement of the supply common channel 31*d* and the return common channel 32*d* is opposite. Namely, in the rows R1 and R2, the return common channel 32*d* is arranged on the upstream side in the conveyance direction and the supply common channel 31*d* is arranged on the downstream side in the conveyance direction; in the rows R3 and R4, the supply common channel 31*d* is arranged on the upstream side in the conveyance direction and the return common channel 32*d* is arranged on the downstream side in the conveyance direction. Each of the supply common channels 31*d* extends in the paper width direction, and overlaps, in the vertical direction, with the inflow paths 33*a* communicating with the pressure chambers 33*c*, respectively, belonging to one of the rows R1 to R4. Each of the return common channels 32*d* extends in the paper width direction, and overlaps, in the vertical direction, with the outflow paths 33*f* communicating with the pressure chambers 33*c*, respectively, belonging to one of the rows R1 to R4.

As described above, channel groups corresponding to the four color inks, respectively, are formed in the channel unit 20 so as to correspond to the four rows R1 to R4, respectively. Each of the channel groups includes the plurality of individual channels 33, the supply common channel 31*d* and the return common channel 32*d*.

As depicted in FIG. 3, the plate unit 22 is constructed of three plates 22*a* to 22*c* which are stacked on top of one another in the vertical direction and adhered to one another. The supply and return common channels 31*d* and 32*d* are formed across and through the three plates 22*a* to 22*d*. The plate 22*b* included in the three plates 22*a* to 22*d* and located in the center in the vertical direction is provided with filters F1 and F2 which are disposed in through holes constructing the supply and return common channels 31*d* and 32*d*, respectively.

Each of the filters F1 and F2 is, for example, an electroformed filer, a mesh filter, etc., and a plurality of fine through holes are formed in the entire area of each of the filters F1 and F2. As compared with the mesh filter, the electroformed filter can be produced highly precisely, and has finely formed holes, and has a high filtration performance. For example, each of the through holes in the electroformed filter has a diameter which is approximately 10 μm, whereas each of the through holes in the mesh filter has a diameter which is approximately 20 μm.

The plate 21 is arranged on the upper surface of the plate unit 22. Supply holes 31*x* are formed in the plate 21 at parts or portions thereof each of which overlaps, in the vertical direction, with one end in the paper width direction of one of the supply common channels 31*d*; and return holes 32*x* are formed in the plate 21 at parts or portions thereof each of which overlaps, in the vertical direction, with one end in the paper width direction of one of the return common channels 32*d*.

The plurality of individual channels 33, the supply common channel 31*d* and the return common channel 32*d* belonging to each of the rows R1 to R4 are communicated with a storing chamber 7*a* of a sub tank 7, via one of the supply holes 31*x* and one of the return holes 32*x*. The sub tank 7 is provided as sub tanks 7 which are provided on the rows R1 to R4, respectively, and store the respective color inks in the storing chambers 7*a* thereof, respectively. Specifically, a sub tank 7 storing the black ink is provided with respect to the row R1; a sub tank 7 storing the yellow ink is provided with respect to the row R2; a sub tank 7 storing the cyan ink is provided with respect to the row R3; and a sub tank 7 storing the magenta ink is provided with respect to the row R4.

Four main tanks (not depicted in the drawings) configured to store the black, yellow, cyan and magenta inks, respectively, are installed in the printer 100. The sub tank 7 provided with respect to the row R1 communicates with the main tank storing the black ink, and stores the black ink supplied from the main tank in the storing chamber 7*a*; the sub tank 7 provided with respect to the row R2 communicates with the main tank storing the yellow ink, and stores the yellow ink supplied from the main tank in the storing chamber 7*a*; the sub tank 7 provided with respect to the row R3 communicates with the main tank storing the cyan ink, and stores the cyan ink supplied from the main tank in the storing chamber 7*a*; and the sub tank 7 provided with respect to the row R4 communicates with the main tank storing the magenta ink, and stores the magenta ink supplied from the main tank in the storing chamber 7*a*.

In the following, the relationship between the sub tanks 7 belonging to the row R1 to R4, respectively, and the plurality of individual channels 33, etc., will be explained.

An outlet port 7*ay* of the storing chamber 7*a* is connected to inlet ports 33*x* of the plurality of individual channels 33, via the supply channel 31. The inlet ports 33*x* correspond to an upper end of the inflow channel 33*a*. The supply channel 31 has a channel 31*a* having one end connected to the outlet port 7*ay* and the other end connected to a supply pump P1; a channel 31*b* having one end connected to the supply pump P1 and the other end connected to an open/close valve V1; a channel 31*c* having one end connected to the open/close valve V1 and the other end connected to the supply common channel 31*d* via the supply port 31*x*; and the supply common channel 31*d*.

An inlet port 7*ax* of the storing chamber 7*a* is connected to outlet ports 33*y* of the plurality of individual channels 33, via the return channel 32. The outlet ports 33*y* correspond to an upper end of the outflow path 33*f*. The return channel 32 has a channel 32*a* having one end connected to the inlet port 7*ax* and the other end connected to a return pump P2; a channel 32*c* having one end connected to the return pump P2 and the other end connected to the return common channel 32*d* via the return hole 32*x*; and the return common channel 32*d*.

The channels 31*a*, 31*b*, 31*c*, 32*a* and 32*c* are defined by tubes, etc., respectively.

The open/close valve V1 is controlled by the controller 10 to be thereby switched between an open position in which the open/close valve V1 allows communication between the storing chamber 7*a* and the plurality of individual channels via the supply channel 31, and a close position in which the open/close valve V1 suppresses the above-described communication. The supply pump P1 is driven by being controlled by the controller 10, and applies pressure in a direction from the outlet port 7*ay* of the storing chamber 7*a* toward the supply hole 31*x* to the ink to thereby move the ink from the storing chamber 7*a* to each of the plurality of individual channels 33 via the supply channel 31. The return pump P2 is driven by being controlled by the controller 10, and applies pressure in a direction from the inlet port lax of the storing chamber 7*a* toward the return hole 32*x* to the ink to thereby move the ink from the storing chamber 7*a* to each of the plurality of individual channels 33 via the return channel 32. It is possible to adopt pumps, in which any pulsatory motion hardly occurs (for example, pumps provided with regulators configured to adjust the pressure), in view of applying a desired pressure, as the supply pump P1 and the return pump P2, respectively.

The open/close valve V1, the supply pump P1 and the return pump P2 are provided with respect to each of the rows R1 to R4, similarly to the sub tank 7.

Arrows in FIG. 3 indicate flow of the ink in a case that the open/close valve 1 is at the open position, that the supply pump P1 is driven, and that the driving of the return pump P2 is stopped. In this situation, the ink inside the storing chamber 7*a* flows out of the outflow port 7*ay*, passes through the channels 31*a* to 31*c*, further flows through the supply common channel 31*d*, and reaches each of the individual channels 33. The ink inflowed from the inlet port 33*x* into each of the individual channels 33 passes through the inflow paths 33*a* and 33*b*, enters into each of the pressure chambers 33*c*, a part of the ink is exhausted (discharged) from one of the nozzles 33*d*, remainder of the ink passes through the outflow paths 33*e* and 33*f* and flows out from the outlet port 33*y*. The ink flowed out from each of the individual channels 33 via the outlet port 33*y* passes through the return common channel 32*d*, further passes through the channels 32*c* and 32*a*, and returns to the storing chamber 7*a* from the inlet port lax. By allowing the ink to circulate along a circulation route starting from and returning to the storing chamber 7*a* via the supply channel 31, the plurality of individual channels 33 and the return channel 32 in the above-described manner, it is possible to exhaust any air bubbles inside each of the individual channels 33 and to prevent any increase in the viscosity of the ink. Further, in a case that the ink contains a sediment component (a component which might sediment or settle; a pigment, etc.), such a sediment component is agitated, which in turn prevents any sedimentation thereof from occurring.

Next, referring to FIG. 5, an explanation will be given about an air-bubble removing processing of removing air bubbles executed by the controller 10. In a case that the power source of the printer 100 is switched ON, the controller 10 executes the air-bubble removing processing as described below, before executing a recording processing.

At a time of starting the air-bubble removing processing, the head unit 1*x* is arranged at a position (stand-by position) at which the four heads 1 overlap, in the vertical direction, with four caps 6 (see FIG. 1), respectively. It is allowable that each of the cap units 6*x* is arranged at the capping position, or that each of the cap units 6*x* is not arranged at the capping position. Namely, it is allowable that the lip part 6*a* makes contact with the nozzle surface 25*a*, or that the rip part 6*a* does not make contact with the nozzle surface 25*a*. In the air-bubble removing processing, the ink exhausted from the nozzles 33*d* in the air-bubble removing processing is received by each of the caps 6.

Further, at the time of starting the air-bubble removing processing, the open/close valve V1 is at the close position.

The air-bubble removing processing is executed regarding a color (color ink) selected among the four colors (four color inks) which are the black, yellow, cyan and magenta (inks). For example, it is allowable that the frequency at which the air-bubble removing processing is performed is allowed to be different between the black ink and color inks (yellow, cyan and magenta inks). In such a case, it is allowable that time intervals at which the air-bubble removing processing is executed with respect to the colors (color inks), respectively, are previously stored in the ROM, and that the color (color ink) for which the air-bubble removing processing is to be executed is selected based on the time intervals stored in the ROM. In this situation, it is allowable that all the four colors (four color inks) are selected, or that one to three color(s) (one to three color ink(s)) are/is selected among the four color inks. The controller 10 controls the open/close valve V1 and the supply pump P1 and the return pump P2 corresponding to a selected color (color ink) in the following manner, and to execute the air-bubble removing processing.

Figure 6A:
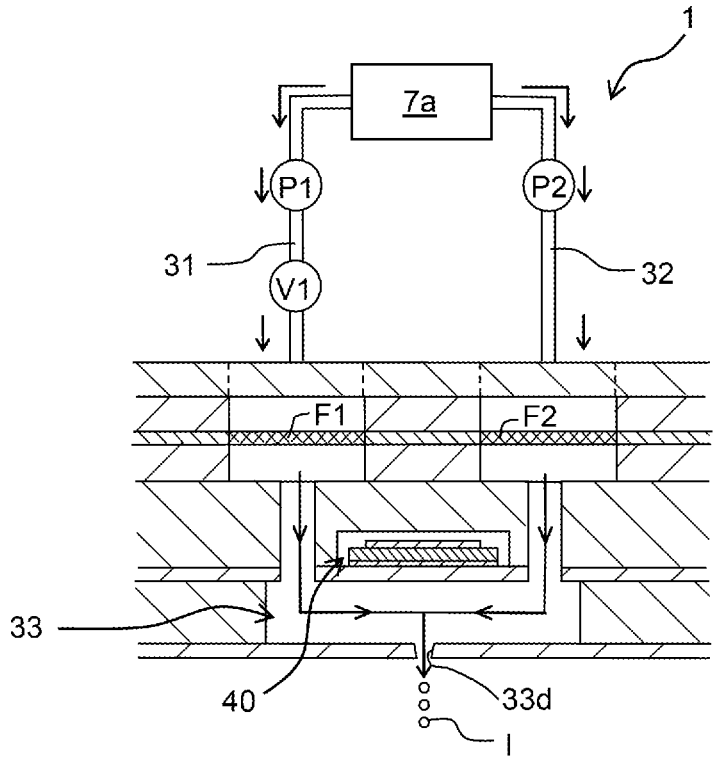
FIG. 6A is a view corresponding to FIG. 3 and depicting a situation during a purge step.

Firstly, the controller 10 performs a pre-purge step. In the pre-purge step, the controller 10 drives both of the supply pump P1 and the return pump P2 (step S1), immediately thereafter switches the open/close valve V1 from the close position to the open position (step S2). With this, as depicted in FIG. 6A, the ink is moved from the storing chamber 7*a* to each of the plurality of individual channels 33 via the supply channel 31, and the ink is moved from the storing chamber 7*a* to each of the individual channels 3 via the return channel 32, thereby exhausting ink I from the nozzle 33*d* of each of the plurality of individual channels 33.

The pressure of each of the supply pump P1 and the return pump P2 in step S1 is, for example, about 80 kPa.

In the supply channel 31, the open/close valve V1 is switched from the close position to the open position in a state that the pressure generated by the supply pump P1 acts on the supply channel 31 in step S1. With this, a large pressure acts on the supply channel 31 at once. With this, it is possible to exhaust any foreign matter (air bubble, dust, etc.) together with the ink I from the nozzle 33*d*, in a small waste liquid amount as compared with a case of allowing the pressure to act on the supply channel 31 gradually.

After the pre-purge step, the controller 10 performs a circulating step. In the circulating step, the controller 10 maintains the open position of the open/close valve V1 and the driving of the supply pump P1, and stops the driving of the return pump P2 (step S3). With this, as depicted in FIG. 3, the ink is circulated along the circulation route starting from and returning to the storing chamber 7*a* via the supply channel 31, the plurality of individual channels 33 and the return channel 32.

The circulating step is performed not only during the air-bubble removing processing but also during the recording processing. The controller 10 makes the pressure of the supply pump P1 in the circulating step (step S3) during the air-bubble removing processing to be greater than the pressure of the supply pump P1 (for example, approximately in a range of 10 Pa to 20 Pa) in the circulating step during the recording processing. Specifically, the controller 10 makes the pressure of the supply pump P1 in the circulating step (step S3) during the air-bubble removing processing to be greater, for example, than withstanding pressure of meniscus in the nozzle 33*d* (for example, approximately in a range of 4 kPa to 5 kPa). The pressure of the pump P1 in step S3 is, for example, about 80 kPa.

In the circulating step, the air bubbles flow together with the ink along the circulation route, and an air bubble A might remain in the inside of the return channel 32 (see FIG. 3). In particular, the air bubble A cannot pass through the filter F2 at the upstream side of the filter F2 in the return common channel 32*d*, and the remaining air bubble A is likely to become large-sized.

Figure 6B:
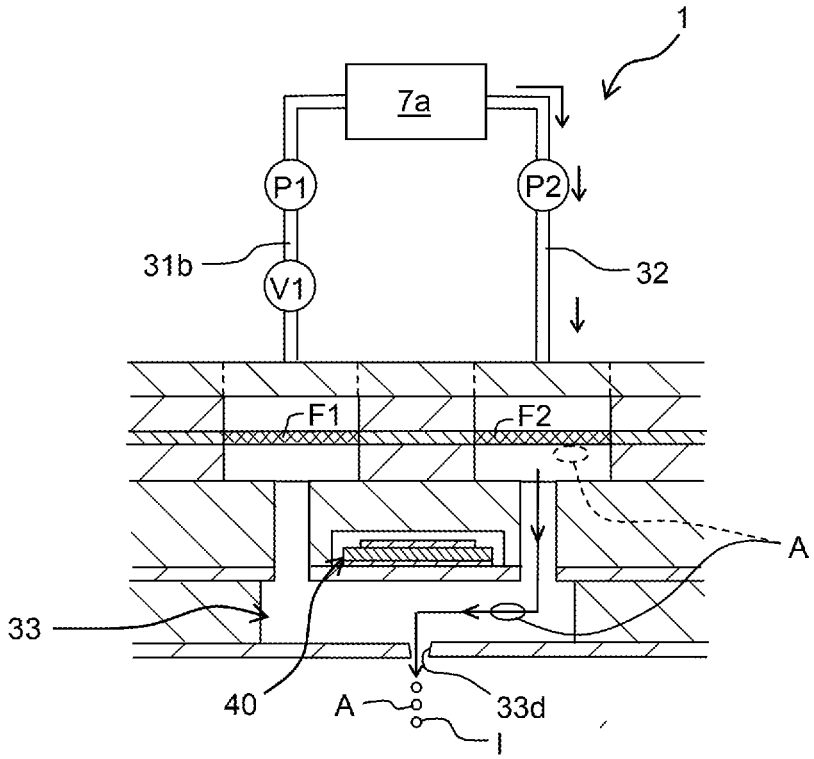
FIG. 6B is a view corresponding to FIG. 3 and depicting a situation during a return purge step.

After the circulating step, the controller 10 performs a return purge step. In the return purge step, the controller 10 stops the driving of the supply pump P1, and switches the open/close valve V1 from the open position to the close position (step S4). After step S4, the controller 10 maintains the stopping of driving of the supply pump P1 and the close position of the open/close valve V1, and drives the return pump P2 (step S5). With this, as depicted in FIG. 6B, the ink is moved from the storing chamber 7*a* to the plurality of individual channels 33 via the return channel 32. With this, the ink I is exhausted (discharged) from the nozzles 33*d* of the plurality of individual channels 33.

Note that the open/close valve V1 is made to be at the close position in steps S4 and S5 for the following reason: namely, in a case that the return pump P2 is driven while allowing the open/close valve V1 to be at the open position, there is such a possibility that the air bubble A might flow to the supply channel 31; the open/close valve V1 is made to be at the close position for avoiding such a possibility.

The pressure of the return pump P2 in step S5 is, for example, about 80 kPa.

In the return purge step, the air bubble A remaining inside the return channel 32 is moved together with the ink, and is moved toward the nozzle 33*d*. This air bubble A is exhausted (discharged) from the nozzle 33*d* together with the ink I (see FIG. 6B).

After the return purge step, the controller 10 performs a post-purge step. In the post-purge step, the controller 10 drives both of the supply pump P1 and the return pump P2 (step S6), and immediately thereafter switches the open/close valve V1 from the close position to the open position (step S7). With this, similarly to the pre-purge step, as depicted in FIG. 6A, the ink is moved from the storing chamber 7*a* to each of the plurality of individual channels 33 via the supply channel 31, and the ink is moved from the storing chamber 7*a* to each of the individual channels 3 via the return channel 32, thereby exhausting ink I from the nozzle 33*d* of each of the plurality of individual channels 33.

In the pre-purge step, the pressures of the supply pump P1 and the return pump P2 are both made to be approximately 80 kPa, whereas in the post-purge step, the pressure of the supply pump P1 and the pressure of the return pump P2 are made to be mutually different. Specifically, in step S6, the controller 10 makes the pressure of the supply pump P1 to be greater than the pressure of the return pump P2. For example, it is allowable that the pressure of the supply pump P1 is made to be approximately 96 kPa, and the pressure of the return pump P2 is made to be approximately 64 kPa.

The driving time of the pump in each of the pre-purge step, the circulating step, the return purge step and the post-purge step is approximately 15 seconds in a case that a predetermined time has not elapsed since the air-bubble removing processing executed the last time. The controller 10 causes the RAM to store the timing at which the air-bubble removing processing has been executed and in the air-bubble removing processing which is to be executed in a case that the predetermined time has elapsed since the air-bubble removing processing executed the last time, the controller 10 makes the driving time of the pump in each of the pre-purge step, the circulating step, the return purge step and the post-purge step to be longer than 15 seconds (for example, approximately 30 seconds). The predetermined time is, for example, approximately 1 (one) hour. In such a case that the power source of the printer 100 has been switched OFF, and then the power source of the printer 100 is switched ON after a time period which is not less than one hour thereafter has elapsed, each of the pre-purge step, the circulating step, the return purge step and the post-purge step is performed for a period of time longer than the usual period of time.

After performing the post-purge step, the controller 10 ends this routine.

Figure 5:
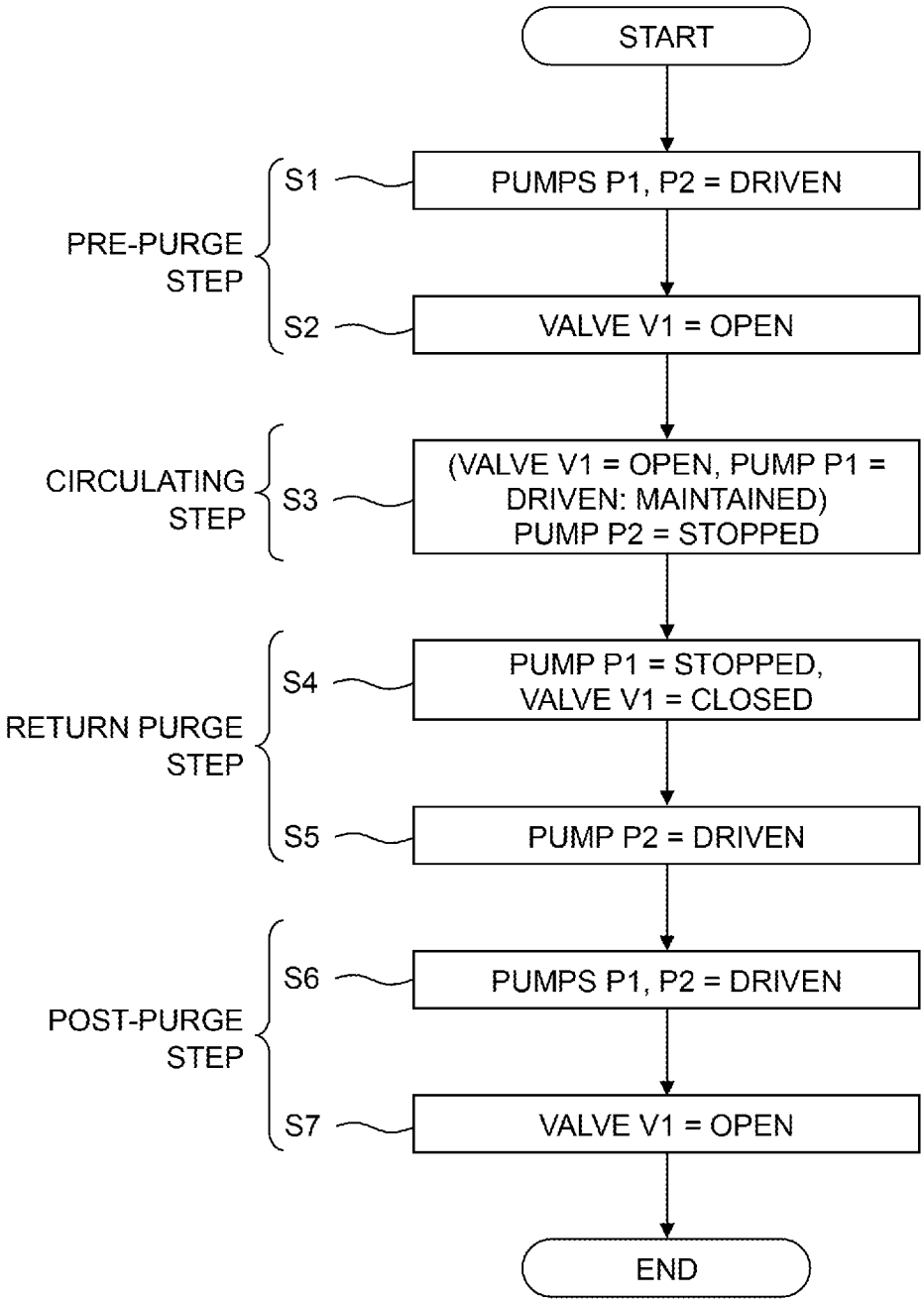
FIG. 5 is a flow chart depicting an air-bubble removing processing executed by a controller 10 of the printer 100.

As described above, according to the present embodiment, in a case that the controller 10 executes the air-bubble removing processing, the controller 10 firstly performs the circulating step and then performs the return purge step (see FIG. 5). In the circulating step (FIG. 3), the air bubbles A might gather in the return channel 32, might combine with each other and might become large-sized. Then, in the return purge step (see FIG. 6B), the large-sized air bubble A is exhausted from the nozzle 33*d* together with the ink. In a case that the air bubble is small-sized, since the surface area of the air bubble A is small and thus the pressure toward the nozzle 33*d* is less likely to act on the air bubble A, the floating forces of the air bubble A is dominant, which in turn requires a large pressure for exhausting the air bubble A. In view of this situation, in the present embodiment, the large-sized air bubble A can be efficiently exhausted with a small pressure. Namely, the air bubble A can be removed efficiently.

The filters F1 and F2 are provided on the supply channel 31 and the return channel 32, respectively (see FIG. 3). In this case, it is possible to prevent any foreign matter from entering into the individual channel 33 from each of the supply channel 31 and the return channel 32. However, in such a configuration provided with the filters F1 and F2, since the air bubble A hardly passes through the filters F1 and F2, and thus the air bubble A might remain between the filters F1 and F2 and the individual channel 33, which in turn might cause any clogging of the filters F1 and F2. This consequently might increase the resistance in channel and might lead to any shortage in the supply of the ink to the individual channel 33. In view of this situation, in the circulating step (see FIG. 3) of the present embodiment, the air bubbles A might gather in the vicinity of the filter F2 of the return channel 32, might combine with each other and might become large-sized. Then, in the return purge step (see FIG. 6B), the large-sized air bubble A is exhausted from the nozzle 33*d* together with the ink I. With this, the air bubble A can be efficiently exhausted, thereby making it possible to suppress any clogging of the filters F1 and F2 and any problem associated therewith. Namely, the present disclosure is particularly effective in the configuration provided with the filters F1 and F2.

In a case that the controller 10 executes the air-bubble removing processing, the controller 10 performs the post-purge step after performing the return purge step (see FIG. 5). In such a case, the air bubble A can be removed more assuredly, by performing the post-purge step (see FIG. 6A).

In the post-purge step, the controller 10 drives both of the supply pump P1 and the return pump P2 (see step S6 in FIG. 5). In the head 1 of the circulating type as in the present embodiment, the supply pump P1 and the return pump P2 are generally provided. In a case that the post-purge step is performed by using another mechanism, the number of parts is increased, whereas in the present embodiment, the post-purge step is performed by using the supply pump P1 and the return pump P2, thereby making it possible to suppress the increase in the number of parts.

The controller 10 makes the pressure of the supply pump P1 and the pressure of the return pump P2 to be mutually different in the post-purge step. In a case that the pressure of the supply pump P1 and the pressure of the return pump P2 are made to be same with each other, the air bubbles A (see FIG. 3) in the ink flowing from the both sides, namely from the supply channel 31 and the return channel 32 might remain at a location immediately below the actuator 40. In such a case, the deformation of the actuator 40 might be hindered by the air bubble A. According to the above-described configuration, by making the pressure of the supply pump P1 and the pressure of the return pump P2 to be mutually different in the post-purge step, the air bubble A is moved to a location away from the actuator 40, thereby making it possible to prevent the air bubble A from remaining in the location immediately below the actuator 40. Thus, the problem that the deformation of the actuator 40 is hindered by the air bubble A can be suppressed.

In the post-purge step, the controller 10 makes the pressure of the supply pump P1 to be greater than the pressure of the return pump P2. In a case that the pressure of the return pump P2 is made to be greater than the pressure of the supply pump P1, the air bubble A might remain at a location on the side of the supply channel 31 than at the location immediately below the actuator 40. In such a case, in the circulating step during the recording processing, the air bubble A might be moved from the side of the supply channel 31 toward the location immediately below the actuator 40, and the deformation of the actuator 40 might be hindered by the air bubble A. According to the above-described configuration, this problem can be suppressed.

In a case that the controller 10 executes the air-bubble removing processing, the controller 10 performs the pre-purge step before performing the circulating step (see FIG. 5). In this case, the air bubble A can be removed more assuredly by performing the pre-purge step (see FIG. 6A).

The controller 10 makes the pressure of the supply pump P1 in the circulating step during the air-bubble removing processing to be greater than the pressure of the supply pump P1 in the circulating step during the recording processing. Specifically, the controller 10 makes the pressure of the supply pump P1 in the circulating step during the air-bubble removing processing to be greater than the withstanding pressure of meniscus in the nozzles 33*d*. In this case, in the circulating step during the air-bubble removing processing, it is possible to destroy the meniscus of each of the nozzles 33*d* and to exhaust (discharge) the air bubble A, together with the ink I, from each of the nozzles 33*d*.

In the case that the power source of the printer 100 is switched ON, the controller 10 executes the air-bubble removing processing. In this case, by removing the air bubble A before the recording processing, it is possible to suppress occurrence of a various kinds of problems during the recording processing due to the air bubble A (any unsatisfactory discharge of the ink from the nozzles 33*d*, any shortage in the supply of the ink to the individual channel 33, etc.).

In the air-bubble removing processing to be executed in a case that the predetermined time has elapsed since the air-bubble removing processing executed the last time, the controller 10 performs each of the circulation step and the return purge step for a longer period of time than in a case that the predetermined time has not elapsed since the air-bubble removing processing executed the last time. With this, it is possible to exhaust any air bubbles inside each of the individual channels 33 and to prevent any increase in the viscosity of the ink, more assuredly.

In the channel unit 20 of the head 1, the plurality of individual channels 33, the supply channel and the return channel 32 for each of the plurality of different kinds of liquids (four color inks) are formed while being arranged side by side to one another (see FIG. 2). In this configuration, the widths of the respective channels 31 to 33 have to be narrow, and the various kinds of problems due to the air bubble A might be conspicuous. In view of this, the present embodiment is capable of efficiently removing the air bubble A, and thus is particularly effective in the above-described configuration.

The printer 100 is provided with the supply pump P1 and the return pump P2 corresponding to each of the plurality of different kinds of liquids (four color inks). In a case that the controller 10 executes the air-bubble removing processing regarding a selected color (color ink) which is selected among the four colors (four color inks), the controller 10 uses a pump P1 and a pump P2 which are included in the pumps P1 the pumps P2 and which correspond to the selected color, rather than using all the pumps P1 and all the pumps P2. With this, it is possible to suppress any wasteful exhaust (discharge) of the ink, and thus to suppress the amount of waste liquid.

Second Embodiment

Next, a printer according to a second embodiment of the present disclosure will be explained, with reference to FIGS.

7 and 8. With respect to a part or portion, of the configuration of the second embodiment, which is same as that of the first embodiment, a same reference number or symbol is assigned, and any detailed explanation for such a part or portion will be omitted in some cases.

The second embodiment is different from the first embodiment in having a configuration wherein a check valve V2 is provided, rather than the open/close valve V1, and in the content of the air-bubble removing processing.

Figure 7:
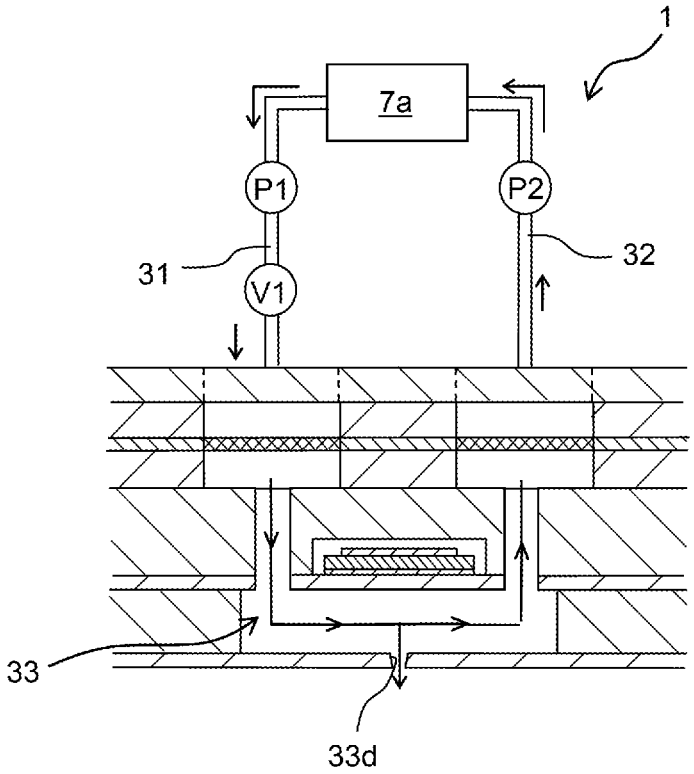
FIG. 7 is a view corresponding to FIG. 3 and according to a second embodiment.

The check valve V2 allows a flow of the ink from the storing chamber 7*a* to the plurality of individual channels 33 via the supply channel 31 (flow of the ink indicated by arrows in FIG. 7), and suppresses a flow of the ink from the plurality of individual channels 33 to the storing chamber 7*a* via the supply channel 31 (flow in a direction reverse to the direction of the flow of the ink indicated by arrows in FIG. 7). Specifically, the check valve V2 is configured to open the channel in a case that the pressure on the side of the storing chamber 7*a* is greater by a predetermined pressure (for example, 1 kPa to 2 kPa) than the pressure on the side of the individual channels 33, and to close the channel in a case different from the above case.

Figure 8:
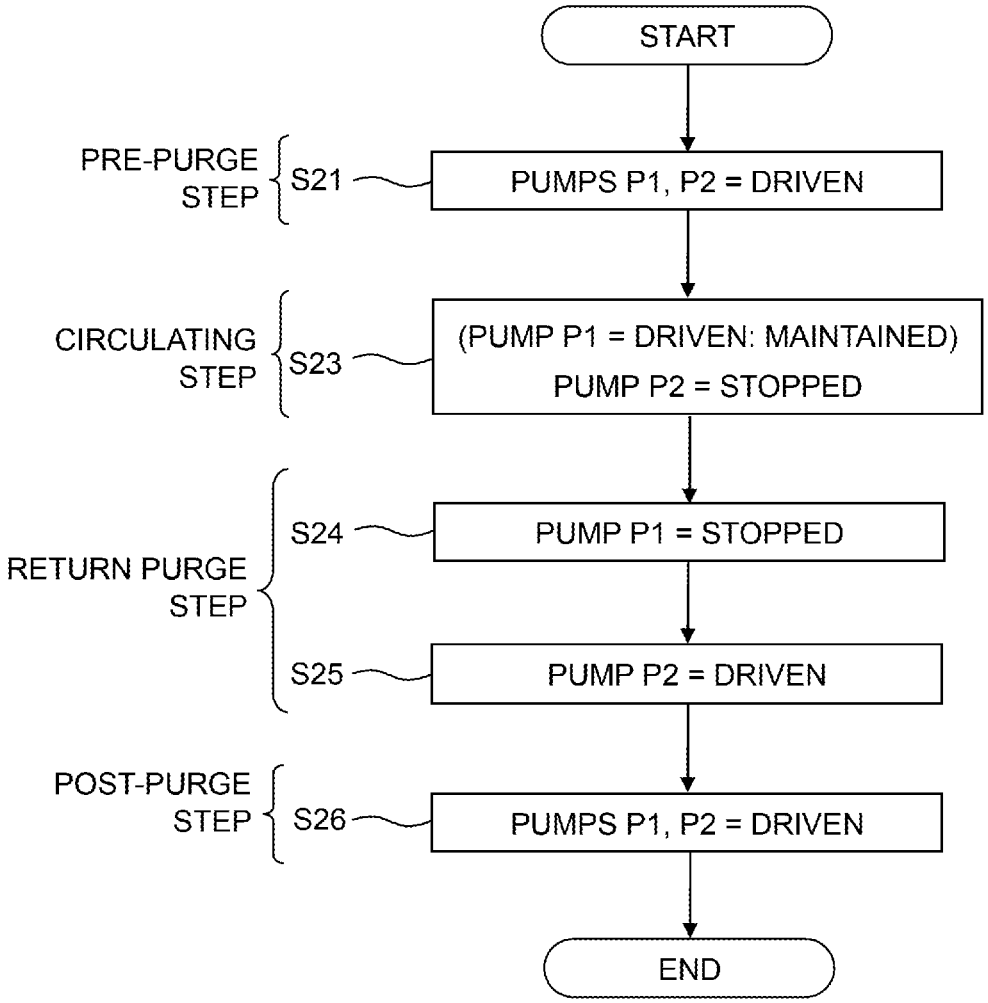
FIG. 8 is a flow chart depicting an air-bubble removing processing according to the second embodiment.

In a case of executing the air-bubble removing processing, the controller performs the pre-purge step, the circulating step, the return purge step and the post-purge step sequentially as depicted in FIG. 8, in a similar manner as in the first embodiment (FIG. 5). In the first embodiment, the opening/closing control of the open/close valve V1 is performed in each of the steps, whereas in the second embodiment, any opening/closing control of the valve is not performed, since the check valve V2 is adopted, instead of adopting the open/close valve V1. Specifically, the air-bubble removing processing in the second embodiment is executed as follows.

In the pre-purge step, the controller drives both of the supply pump P1 and the return pump P2 (step S21). In this situation, the flow of the ink is allowed in the check valve V2, and the ink is moved from the storing chamber 7*a* to the plurality of individual channels 33 via the supply channel 31, and the ink is moved from the storing chamber 7*a* to the plurality of individual channels 33 via the return channel 32, thereby causing the ink to be exhausted (discharged) from the nozzles 33*d* of the plurality of individual channels 33.

In the circulating step, the controller maintains the driving of the supply pump P1 and stops the driving of the return pump P2 (step S23). In this situation, the flow of the ink is allowed in the check valve V2, and the ink is circulated along a circulation route starting from, and returning to, the storing chamber 7*a* via the supply channel 31, the plurality of individual channels 33 and the return channel 32, as depicted in FIG. 7.

In the return purge step, the controller stops the driving of the supply pump P1 (step S24). After the step S24, the controller maintains the stopping of driving of the supply pump P1, and drives the return pump P2 (step S25). In this situation, the flow of the ink is suppressed in the check valve V2, and the ink is moved from the storing chamber 7*a* to the plurality of individual channels 33 via the return channel 32. With this, the ink is exhausted (discharged) from the nozzles 33*d* of the plurality of individual channels 33.

In the post-purge step, the controller drives both of the supply pump P1 and the return pump P2 (step S26). In this situation, the flow of the ink is allowed in the check valve V2, and the ink is moved from the storing chamber 7*a* to the plurality of individual channels 33 via the supply channel 31, and the ink is moved from the storing chamber 7*a* to the plurality of individual channels 33 via return channel 32. With this, the ink is exhausted (discharged) from the nozzles 33*d* of the plurality of individual channels 33.

As described above, according to the second embodiment wherein the check valve V2 is adopted, rather than the open/close valve V1, in the case that the controller executes the air-bubble removing processing, the controller firstly performs the circulating step and then performs the return purge step (see FIG. 8) in a similar manner to that in the first embodiment. Accordingly, it is possible to achieve such an effect that a large-sized air bubble can be exhausted efficiently with a small pressure by performing the return purge step after performing the circulating step, in a similar manner to that in the first embodiment.

Third Embodiment

Figure 9:
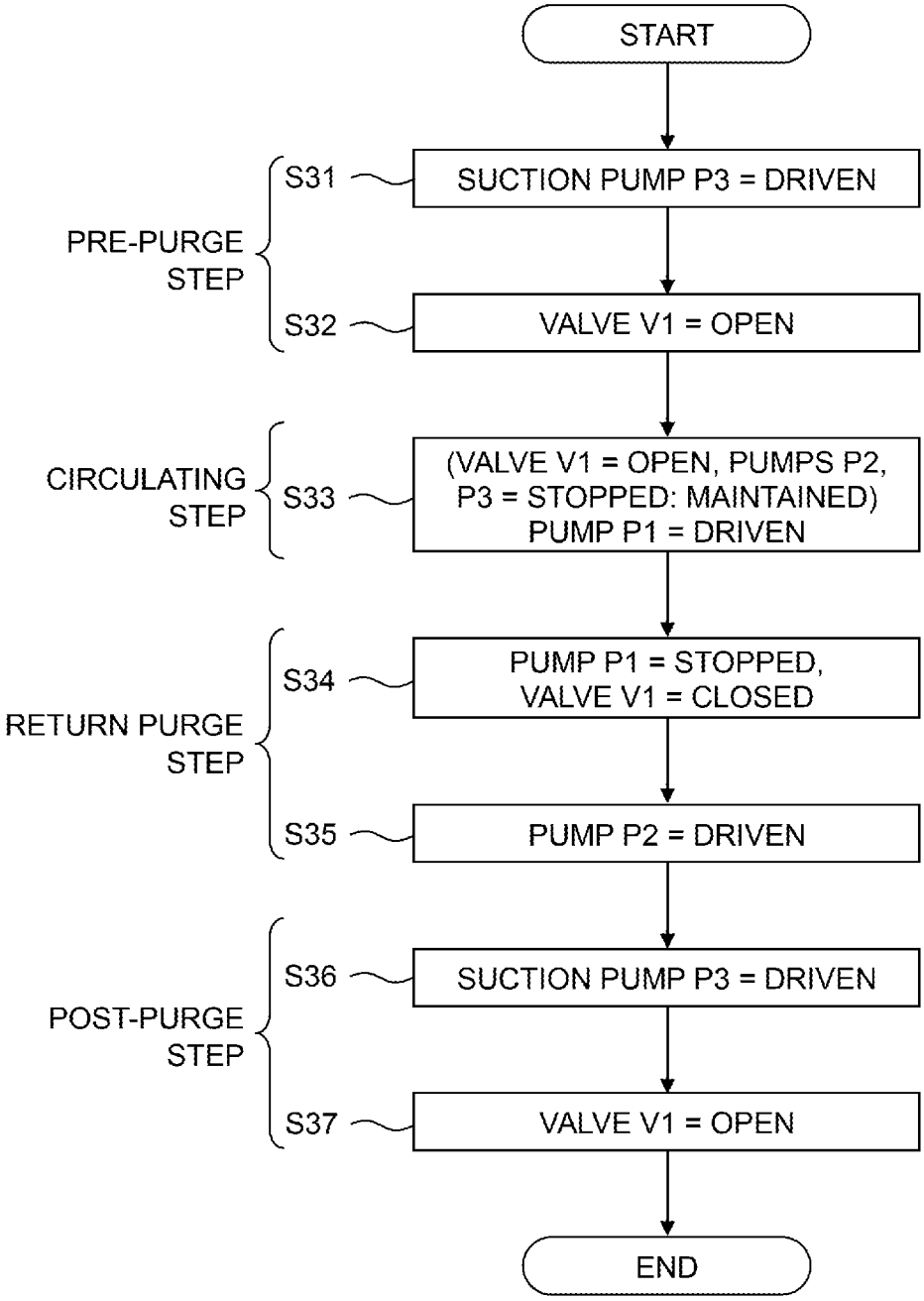
FIG. 9 is a flow chart depicting an air-bubble removing processing according to a third embodiment.

Next, a printer according to a third embodiment of the present disclosure will be explained, with reference to FIG. 9. With respect to a part or portion, of the configuration of the third embodiment, which is same as those of the first and second embodiments, a same reference number or symbol is assigned, and any detailed explanation therefor will be omitted in some cases.

The third embodiment is different from the first embodiment in the content of the air-bubble removing processing.

In a case of executing the air-bubble removing processing, the controller performs the pre-purge step, the circulating step, the return purge step and the post-purge step sequentially, in a similar manner as in the first embodiment (FIG. 5). In the first embodiment, the supply pump P1 and the return pump P2 are used in the pre-purge step and in the post-purge step, whereas in the third embodiment, a suction pump P3 is used in the pre-purge step and in the post-purge step.

At a time of starting the air-bubble removing processing, the head unit 1*x* is arranged at a position at which the four heads 1 overlap, in the vertical direction, with the four caps 6 (see FIG. 1), respectively (stand-by position). The cap unit 6*x* is arranged at the capping position (namely, the cap unit 6*x* is in a state that the lip part 6*a* makes contact with the nozzle surface 25, and that all the nozzles 33*d* of each of the heads 1 are covered by one of the caps 6). Accordingly, in the third embodiment, the air-bubble removing processing is executed regarding all the four colors (four color inks) included in each of the head 1, rather than being executing regarding a selected color (color ink) among the four colors (four color inks).

In the pre-purge step, the controller drives the suction pump P3 in a state that the stopping of driving of the supply pump P1 and the stopping of driving of the return pump P2 are maintained (step S31), immediately thereafter switches the open/close valve V1 from the close position to the open position (step S32). In this situation, a suction force is generated inside each of the caps 6, and the ink is moved from the storing chamber 7*a* to each of the plurality of individual channels 33 via the supply channel 31, and the ink is moved from the storing chamber 7*a* to each of the individual channels 3 via the return channel 32, thereby exhausting ink from the nozzle 33*d* of each of the plurality of individual channels 33 of one of the heads 1. The driving of the suction pump P3 is stopped after a predetermined time elapses.

In the circulating step, the controller maintains the open position of the open/close valve V1 and stopping of driving of the return pump P2 and stopping of driving of the suction pump P3, and drives the supply pump P1 (step S33). In the return purge step, the controller performs steps S34 and S35 which are similar to steps S4 and S5 in the first embodiment.

In the post-purge step, the controller drives the suction pump P3 in a state that the stopping of driving of the supply pump P1 and the stopping of driving of the return pump P2 are maintained (step S36), immediately thereafter switches the open/lose valve V1 from the close position to the open position (step S37). In this situation, the suction force is generated in the inside of each of the caps 6, similarly in the pre-purge step, and the ink is moved from the storing chamber 7 to the plurality of individual channels 33 via the supply channel 31 and the ink is moved from the storing chamber 7 to the plurality of individual channels 33 via the return channel 32, thereby exhausting the ink from all the nozzles 33*d* of each of the heads 1. The driving of the suction pump P3 is stopped after a predetermined time elapses.

As described above, according to the third embodiment, the air bubble A in the vicinity of the nozzle 33*d* can be efficiently removed by performing each of the purge steps with the suction pump P3. Further, in a case of performing each of the purge steps by using the supply pump P1 and the return pump P2, there might be such a problem that a swirl is generated immediately below the actuator 40 and that it might be difficult to exhaust the air bubble A. In the case of performing each of the purge steps by using the suction pump P3 as in the third embodiment, however, the above-described problem caused due to the occurrence of swirl is hardly generated.

<Modifications>

Although the embodiments of the present disclosure have been explained in the foregoing, the present disclosure is not limited to or restricted by the above-described embodiments; it is allowable to make a various kind of changes to the present disclosure, within the scope described in the claims.

For example, in a case of performing the purge step with the supply pump and the return pump as in the first embodiment, the suction pump and/or the caps may be omitted.

The pump may be a bidirectional pump. For example, in the above-described embodiment, it is allowable that the return pump P2 is a bidirectional pump (having a driving mode switchable between a forward driving by which pressure in a direction from the return hole 32*x* toward the inlet port 7*ax* of the storing chamber 7*a* is imparted to the ink, and a reverse driving by which pressure in a direction from the inlet port 7*ax* of the storing chamber 7*a* toward the return hole 32*x* is imparted to the ink), and that the return pump P2 is driven in the forward direction in the circulating step and the return pump P2 is driven in the reverse direction in each of the pre-purge step and the post-purge step. In a case of driving the return pump P2 in the forward direction in the circulating step, if the pressure of the return pump P2 is too great, there is a such a possibility that the air is drawn from the nozzle; thus, it is possible to make the pressure of the return pump P2 to be smaller than the pressure of the supply pump P1. Further, in this case, it is allowable that the supply pump P1 is omitted, that the circulating step is performed by driving the return pump P2 in the forward direction, and that the return purge step is performed by driving the return pump P2 in the reverse direction.

In the above-described embodiment, although each of the open/close valve and the check valve is arranged between the supply pump and the supply hole, each of the open/close valve and the check valve may be arranged between the storing chamber and the supply pump. Each of the open/close valve and the check valve may be provided on the return channel (for example, between the storing chamber and the return pump).

It is allowable to provide the filter on only one of the supply channel and the return channel, or on neither of the supply channel and the return channel.

In the circulating step, it is allowable that the liquid is exhausted from the nozzle, or the liquid is not exhausted from the nozzle. It is allowable to make the pressure of the pump in the circulating step during the air-bubble removing processing to be not more than the pressure of the pump in the circulating step during the recording processing, or not more than the withstanding pressure of the meniscus in the nozzle.

In the pre-purge step, it is allowable to make the pressure of the supply pump to be different from the pressure of the return pump, similarly in the post-purge step. It is allowable to omit the pre-purge step.

In the post-purge step, it is allowable to make the pressure of the supply pump to be smaller than the pressure of the return pump. Alternatively, in the post-purge step, it is allowable to make the pressure of the supply pump and the pressure of the return pump to be same with each other. It is allowable to omit the post-purge step.

The air-bubble removing processing may be executed not only when the power source of the liquid discharge apparatus is switched ON, but also at a timing designated by a user, or every predetermined period. Further, in the air-bubble removing processing performed every time, a period of time during which each of the steps, such as the circulating step, the return purge step, etc., may be uniform (in the air-bubble removing processing to be executed in a case that the predetermined time has elapsed since the air-bubble removing processing executed the last time, it is allowable that each of the steps is not performed for a long period of time).

It is allowable to execute the air-bubble removing processing regarding all a plurality of different kinds of liquids at a time, rather than regarding a selected liquid among the plurality of different kinds of liquids (see the third embodiment).

It is allowable to form individual channels, a supply channel and a return channel only for one kind of liquid (for example, black ink), in one piece of the liquid discharging head.

The number of each of the supply and return channels provided on one piece of the liquid discharging head are not limited to a plural, and may be 1 (one). For example, it is allowable that one supply channel and one return channel corresponding to one kind of liquid are provided on one piece of the liquid discharging head.

The position of the supply hole and the position of the return hole are not particularly limited. For example, in the first embodiment, it is allowable that in the first embodiment (see FIG. 2), the supply hole 31*x* is provided on one end in the extending direction of the supply common channel 31*d*, and the return hole 32*x* is provided on the other end in the extending direction of the return common channel 32*d*. In this case, the flows of the ink are reverse to each other in one set of the supply and return common channels.

It is allowable to provide two or more pieces of the supply hole with respect to one piece of the supply common channel. In this case, in a plurality of individual channels communicating with one piece of the supply common channel, the pressure applied to the individual channels becomes greater as a distance therefrom to the supply hole is shorter; however, it is possible to suppress the variation (unevenness) in the applied pressure among the individual channels, as compared with a case of supplying the liquid in one piece of the supply common channel from one supply hole.

It is allowable to provide two or more pieces of the return hole with respect to one piece of the return common channel. In this case, in a plurality of individual channels communicating with one piece of the return common channel, the pressure applied to the individual channels becomes greater as a distance therefrom to the return hole is shorter; however, it is possible to suppress the variation (unevenness) in the applied pressure among the individual channels, as compared with a case of exhausting the liquid in one piece of the return common channel from one return hole.

The number of the nozzles and the number of the pressure chambers included in each of the individual channels are not particularly limited. For example, it is allowable that each of the individual channels includes one nozzle and two pressure chambers. It is allowable that each of the individual channels includes two or more nozzles.

The actuator is not limited to or restricted by being of the piezo system using the piezoelectric element, and may be of another system (for example, a thermal system using a heating element, an electrostatic system using the electrostatic force, etc.).

The liquid discharging head is not limited to being of the line system, and may be of the serial system (system for discharging the liquid(s) from the nozzles toward a discharge target while moving in a scanning direction parallel to a paper width direction).

The discharge target is not limited to a paper sheet (paper), and may be, for example, cloth, fabric, substrate, etc.

The liquid which is to be discharged from the nozzles is not limited to the ink, and may be any liquid (for example, a treatment solution for aggregating or depositing (precipitating) a component in an ink, a liquefied metal, a resin, etc.).

The present disclosure is not limited to or restricted by being applicable to a printer, and is applicable also to a facsimile machine, copying machine, a multi-functional peripheral, etc. Further, the present disclosure is applicable also to a liquid discharge apparatus usable in a variety of kinds of usage or application other than recording of an image, etc. For example, the present disclosure is applicable also to a liquid discharge apparatus configured to form a conductive pattern on a substrate by discharging or jetting a conductive liquid onto the substrate.

What is claimed is:

1. A liquid discharge apparatus comprising:

a plurality of individual channels in which a plurality of nozzles are opened, respectively;

a supply channel communicating with an outlet port of a storage chamber storing a liquid and with an inlet port of each of the plurality of individual channels;

a return channel communicating with an outlet port of each of the plurality of individual channels and with an inlet port of the storage chamber;

an open/close valve which is provided on the supply channel and which is switchable between an open position allowing communication between the storing chamber and the plurality of individual channels via the supply channel and a close position suppressing the communication;

a pump provided on the return channel; and a controller, wherein in a case that an air bubble is removed, the controller is configured to control the open/close valve and the pump so as to execute:

circulation of the liquid along a circulation route starting from, and returning to, the storing chamber via the supply channel, the plurality of individual channels and the return channel by maintaining the open/close valve at the open position and driving the pump; and then moving of the liquid from the storing chamber to the plurality of individual channels via the return channel and exhausting of the liquid from the plurality of nozzles of the plurality of individual channels, respectively, by maintaining the open/close valve at the close position and driving the pump.

2. The liquid discharge apparatus according to claim 1, further comprising a plurality of filters which are arranged in the supply channel and the return channel, respectively.

3. The liquid discharge apparatus according to claim 1, wherein in the case that the air bubble is removed, the controller is configured to control the open/close valve and the pump:

to move the liquid from the storing chamber to the plurality of individual channels via the return channel so as to exhaust the liquid from the plurality of nozzles of the plurality of individual channels; and then to move the liquid from the storing chamber to the plurality of individual channels via the supply channel, and to move the liquid from the storing chamber to the plurality of individual channels via the return channel so as to exhaust the liquid from the plurality of nozzles of the plurality of individual channels.

4. The liquid discharge apparatus according to claim 3, wherein the pump includes:

a supply pump which is provided on the supply channel and which is configured to move the liquid from the storing chamber to the plurality of individual channels via the supply channel, and a return pump which is provided on the return channel and which is configured to move the liquid from the storing chamber to the plurality of individual channels via the return channel; and the controller is configured to drive both of the supply pump and the return pump, in a case that the controller removes the air bubble by controlling the open/close valve, the supply pump and the return pump to move the liquid from the storing chamber to the plurality of individual channels via the supply channel, and to move the liquid from the storing chamber to the plurality of individual channels via the return channel so as to exhaust the liquid from the plurality of nozzles of the plurality of individual channels.

5. The liquid discharge apparatus according to claim 4, wherein the controller is configured to make pressure of the supply pump and pressure of the return pump to be mutually different in the case that the controller controls the open/close valve, the supply pump and the return pump to move the liquid from the storing chamber to the plurality of individual channels via the supply channel, and to move the liquid from the storing chamber to the plurality of individual channels via the return channel so as to exhaust the liquid from the plurality of nozzles of the plurality of individual channels.

6. The liquid discharge apparatus according to claim 5, wherein the controller is configured to make the pressure of the supply pump to be greater than the pressure of the return pump in the case that the controller controls the open/close valve, the supply pump and the return pump to move the liquid from the storing chamber to the plurality of individual channels via the supply channel, and to move the liquid from the storing chamber to the plurality of individual channels via the return channel so as to exhaust the liquid from the plurality of nozzles of the plurality of individual channels.

7. The liquid discharge apparatus according to claim 3, further comprising a cap configured to cover the plurality of nozzles of the plurality of individual channels; and a suction pump connected to the cap and configured to generate suction force inside the cap; and wherein the controller is configured to drive the suction pump in a state that the plurality of nozzles of the plurality of individual channels are covered by the cap, in the case that the controller controls the open/close valve and the pump to move the liquid from the storing chamber to the plurality of individual channels via the supply channel, and to move the liquid from the storing chamber to the plurality of individual channels via the return channel so as to exhaust the liquid from the plurality of nozzles of the plurality of individual channels.

8. The liquid discharge apparatus according to claim 1, wherein in the case that the controller removes the air bubble, the controller is configured to control the open/close valve and the pump:

to move the liquid from the storing chamber to the plurality of individual channels via the supply channel, and to move the liquid from the storing chamber to the plurality of individual channels via the return channel so as to exhaust the liquid from the plurality of nozzles of the plurality of individual channels, before the controller executes the circulation of the liquid along the circulation route.

9. The liquid discharge apparatus according to claim 1, wherein while the controller is removing the air bubble, the controller is configured to control the open/close valve and the pump so as to make pressure of the pump while the controller executes the circulation of the liquid along the circulation route to be greater than pressure of the pump while the controller executes the circulation of the liquid along the circulation route during recording.

10. The liquid discharge apparatus according to claim 1, wherein while the controller is removing the air bubble, the controller is configured to control the open/close valve and the pump so as to make pressure of the pump while the controller executes the circulation of the liquid along the circulation route to be greater than withstanding pressure of meniscus in the plurality of nozzles.

11. The liquid discharge apparatus according to claim 1, wherein the controller is configured to remove the air bubble in a case that a power source of the liquid discharge apparatus is turned ON.

12. The liquid discharge apparatus according to claim 1, wherein in a case that the controller executes removal of the air bubble after a predetermined time has elapsed since the controller has executed the removal of the air bubble last time, the controller is configured to execute each of the circulation of the liquid along the circulation route, and the moving of the liquid from the storing chamber to the plurality of individual channels via the return channel so as to exhaust the liquid from the plurality of nozzles of the plurality of individual channels, respectively, for a long period of time as compared with a case that the controller executes the removal the air bubble before the predetermined time elapses since the controller has executed the removal of the air bubble the last time.

13. The liquid discharge apparatus according to claim 1, further comprising a liquid discharging head in which a plurality of sets each of which is composed of the plurality of individual channels, the supply channel and the return channel, which are provided for a plurality of liquids of mutually different kinds, respectively, and which are formed in the liquid discharging head while being arranged side by side to each other.

14. The liquid discharge apparatus according to claim 13, further comprising a plurality of pieces of the pump corresponding to the plurality of liquids, respectively, wherein in a case that the controller removes the air bubble with respect to a certain liquid which is selected among the plurality of liquids, the controller is configured to use a pump, among the plurality of pieces of the pump, which corresponds to the certain liquid.

15. A liquid discharge apparatus comprising:

a plurality of individual channels which include a plurality of nozzles, respectively;

a supply channel communicating with an outlet port of a storage chamber storing a liquid and with an inlet port of each of the plurality of individual channels;

a return channel communicating with an outlet port of each of the plurality of individual channels and an inlet port of the storage chamber;

a check valve which is provided on the supply channel and which is configured to allow a flow of the liquid from the storing chamber to the plurality of individual channels via the supply channel and to suppress a flow of the liquid from the plurality of individual channels to the storing chamber via the supply channel;

a pump provided on the return channel; and a controller, wherein in a case that the controller removes an air bubble, the controller is configured to control the pump so as to execute:

circulation of the liquid along a circulation route starting from, and returning to, the storing chamber via the supply channel, the plurality of individual channels and the return channel, by driving the pump; and then moving of the liquid from the storing chamber to the plurality of individual channels via the return channel and exhausting of the liquid from the plurality of nozzles of the plurality of individual channels, respectively, by driving the pump.

16. The liquid discharge apparatus according to claim 15, further comprising a plurality of filters which are arranged in the supply channel and the return channel, respectively.

17. The liquid discharge apparatus according to claim 15, wherein in the case that the air bubble is removed, the controller is configured to control the open/close valve and the pump:

to move the liquid from the storing chamber to the plurality of individual channels via the return channel so as to exhaust the liquid from the plurality of nozzles of the plurality of individual channels; and then to move the liquid from the storing chamber to the plurality of individual channels via the supply channel, and to move the liquid from the storing chamber to the plurality of individual channels via the return channel so as to exhaust the liquid from the plurality of nozzles of the plurality of individual channels.

18. The liquid discharge apparatus according to claim 17, wherein the pump includes:

a supply pump which is provided on the supply channel and which is configured to move the liquid from the storing chamber to the plurality of individual channels via the supply channel, and a return pump which is provided on the return channel and which is configured to move the liquid from the storing chamber to the plurality of individual channels via the return channel; and the controller is configured to drive both of the supply pump and the return pump, in a case that the controller removes the air bubble by controlling the open/close valve, the supply pump and the return pump to move the liquid from the storing chamber to the plurality of individual channels via the supply channel, and to move the liquid from the storing chamber to the plurality of individual channels via the return channel so as to exhaust the liquid from the plurality of nozzles of the plurality of individual channels.

19. The liquid discharge apparatus according to claim 18, wherein the controller is configured to make pressure of the supply pump and pressure of the return pump to be mutually different in the case that the controller controls the open/close valve, the supply pump and the return pump to move the liquid from the storing chamber to the plurality of individual channels via the supply channel, and to move the liquid from the storing chamber to the plurality of individual channels via the return channel so as to exhaust the liquid from the plurality of nozzles of the plurality of individual channels.

20. The liquid discharge apparatus according to claim 19, wherein the controller is configured to make the pressure of the supply pump to be greater than the pressure of the return pump in the case that the controller controls the open/close valve, the supply pump and the return pump to move the liquid from the storing chamber to the plurality of individual channels via the supply channel, and to move the liquid from the storing chamber to the plurality of individual channels via the return channel so as to exhaust the liquid from the plurality of nozzles of the plurality of individual channels.

21. The liquid discharge apparatus according to claim 17, further comprising a cap configured to cover the plurality of nozzles of the plurality of individual channels; and a suction pump connected to the cap and configured to generate suction force inside the cap; and wherein the controller is configured to drive the suction pump in a state that the plurality of nozzles of the plurality of individual channels are covered by the cap, in the case that the controller controls the open/close valve and the pump to move the liquid from the storing chamber to the plurality of individual channels via the supply channel, and to move the liquid from the storing chamber to the plurality of individual channels via the return channel so as to exhaust the liquid from the plurality of nozzles of the plurality of individual channels.

22. The liquid discharge apparatus according to claim 15, wherein in the case that the controller removes the air bubble, the controller is configured to control the open/close valve and the pump:

to move the liquid from the storing chamber to the plurality of individual channels via the supply channel, and to move the liquid from the storing chamber to the plurality of individual channels via the return channel so as to exhaust the liquid from the plurality of nozzles of the plurality of individual channels, before the controller executes the circulation of the liquid along the circulation route.

23. The liquid discharge apparatus according to claim 15, wherein while the controller is removing the air bubble, the controller is configured to control the open/close valve and the pump so as to make pressure of the pump while the controller executes the circulation of the liquid along the circulation route to be greater than pressure of the pump while the controller executes the circulation of the liquid along the circulation route during recording.

24. The liquid discharge apparatus according to claim 15, wherein while the controller is removing the air bubble, the controller is configured to control the open/close valve and the pump so as to make pressure of the pump while the controller executes the circulation of the liquid along the circulation route to be greater than withstanding pressure of meniscus in the plurality of nozzles.

25. The liquid discharge apparatus according to claim 15, wherein the controller is configured to remove the air bubble in a case that a power source of the liquid discharge apparatus is turned ON.

26. The liquid discharge apparatus according to claim 15, wherein in a case that the controller executes removal of the air bubble after a predetermined time has elapsed since the controller has executed the removal of the air bubble last time, the controller is configured to execute each of the circulation of the liquid along the circulation route, and the moving of the liquid from the storing chamber to the plurality of individual channels via the return channel so as to exhaust the liquid from the plurality of nozzles of the plurality of individual channels, respectively, for a long period of time as compared with a case that the controller executes the removal the air bubble before the predetermined time elapses since the controller has executed the removal of the air bubble the last time.

27. The liquid discharge apparatus according to claim 15, further comprising a liquid discharging head in which a plurality of sets each of which is composed of the plurality of individual channels, the supply channel and the return channel, which are provided for a plurality of liquids of mutually different kinds, respectively, and which are formed in the liquid discharging head while being arranged side by side to each other.

28. The liquid discharge apparatus according to claim 27, further comprising a plurality of pieces of the pump corresponding to the plurality of liquids, respectively, wherein in a case that the controller removes the air bubble with respect to a certain liquid which is selected among the plurality of liquids, the controller is configured to use a pump, among the plurality of pieces of the pump, which corresponds to the certain liquid.

* * * * *